US007140522B2

(12) United States Patent
Kress

(10) Patent No.: US 7,140,522 B2
(45) Date of Patent: Nov. 28, 2006

(54) APPLICATOR FOR HAIR BUILDING SOLIDS

(75) Inventor: Mark Kress, Westport, CT (US)

(73) Assignee: Spencer Forrest, Inc., Westport, CT (US)

( * ) Notice: Subject to any disclaimer, the term of this patent is extended or adjusted under 35 U.S.C. 154(b) by 505 days.

(21) Appl. No.: 10/606,809

(22) Filed: Jun. 26, 2003

(65) Prior Publication Data

US 2004/0262340 A1 Dec. 30, 2004

(51) Int. Cl.
*B05B 11/06* (2006.01)
*A41G 5/00* (2006.01)
*A45D 40/30* (2006.01)

(52) U.S. Cl. ..... 222/633; 222/209; 132/201; 132/212; 132/319

(58) Field of Classification Search ..... 222/630–633, 222/148, 209; 132/270, 201, 56, 53, 54, 132/319; 604/58; 239/349; 424/45–47
See application file for complete search history.

(56) References Cited

U.S. PATENT DOCUMENTS

| | | | | | |
|---|---|---|---|---|---|
| 277,900 | A * | 5/1883 | Hayes | 222/633 |
| 814,820 | A * | 3/1906 | Wood | 239/362 |
| 947,468 | A * | 1/1910 | Fish | 222/209 |
| 1,238,653 | A * | 8/1917 | Euverard | 222/209 |
| 1,459,282 | A * | 6/1923 | Clark | 222/209 |
| 1,478,267 | A * | 12/1923 | Thompson | 222/209 |
| 1,776,489 | A * | 9/1930 | Cobb | 222/633 |
| 1,825,608 | A * | 9/1931 | Shaukis | 239/353 |
| 1,852,685 | A * | 4/1932 | Tremblay | 222/633 |
| 2,264,099 | A * | 11/1941 | Shaw | 604/185 |
| 3,105,619 | A * | 10/1963 | Rohrmuller | 222/209 |
| 3,713,454 | A * | 1/1973 | Tsukisaka | 132/212 |
| 4,043,341 | A * | 8/1977 | Tromovitch | 606/22 |
| 6,168,781 | B1 | 1/2001 | Ukaji et al. | 424/70.11 |
| 6,436,380 | B1 * | 8/2002 | Pond et al. | 424/63 |
| 6,616,067 | B1 * | 9/2003 | Hunter | 239/338 |

* cited by examiner

*Primary Examiner*—Kevin P. Shaver
(74) *Attorney, Agent, or Firm*—Liner, Yankelevitz, Sunshine & Regenstreif LLP

(57) ABSTRACT

An improved applicator for hair building cosmetic fibers, powders and particles uses a gentle stream of gas to suspend the fibers and waft them onto the user's scalp. A low pressure, low velocity gas stream directed downwards into a mass of fibers in a closed container suspends them. The suspended fibers exit through a small orifice connected with a passageway ending in a nozzle. The suspended fibers are propelled from the nozzle in a directed fashion to settle naturally in a controlled area. If a rubber bulb is used to supply air to suspend the fibers, a user can gently squeeze the bulb to allow controlled puffs of air and fibers to waft onto controlled regions of the scalp. A valve arrangement can be operated to provide an air stream to remove excess deposited fibers from regions of the scalp.

10 Claims, 7 Drawing Sheets

APPLICATOR FOR HAIR BUILDING SOLIDS

BACKGROUND OF THE INVENTION

1. Area of the Art

The present invention concerns the field of cosmetic treatments for hair loss.

2. Description of the Prior Art

Although most of the human body is relatively hairless, at least compared to most other mammals, the human head is endowed with a more or less luxuriant growth of hair. Over the ages this hair has been the source of endless trials and tribulations. How many teenagers of either sex have spent endless hours adjusting the exact look of their hair? Pity the poor individual whose coiffure is not up to current group standards. This fascination with hair extends beyond ones teenage years and is usually lifelong. But a luxuriant growth of hair is not guaranteed. Hair is damaged or lost as a result of accident, illness, age and even cosmetic treatments. As humans age the quality as well as the quantity of their head hair tends to change. The number of hairs usually decreases in both sexes but often much more rapidly in those of the male persuasion. Color and texture also undergo changes.

Loss of hair and changes in hair quality have spawned a multi-billions dollar industry that seeks to restore an individual's hair to its youthful status. This preoccupation may seem inevitable in today's youth oriented culture, but "cures" for age-related changes in hair seem to be as old as mankind. Ancient civilizations used wigs, hair coloring agents and hats—remedies that are still in widespread use today. Any study of herbal medicine or "magic" potions will uncover a plethora of mixtures that were guaranteed to grow hair on the baldest of pates.

An inspection of the database of issued patents at the United States Patent and Trademark Office reveals hundreds of inventions aimed at overcoming or ameliorating hair loss. The majority of inventions are directed towards medical treatments employing an incredible range of drugs—all promising to grow hair. Another large group of inventions is directed towards improvements in wigs and toupees and related devices intended to minimize the appearance of hair loss. Yet drug-based treatments are often ineffective, slow or fraught with undesirable or even dangerous side effects. Wigs and toupees or "hair pieces" are often costly, cumbersome and "overkill" as a treatment for regions of thinning hair as opposed to overall complete hair loss.

Techniques involving "mini" wigs designed to cover small regions only or methods that weave or otherwise attach strands of hair into thinning areas have been developed to overcome the inherent problems of wigs. However, such techniques are often expensive and require services of a third party for their fabrication and application. Therefore, simpler "cosmetic" approaches have been developed that allow an individual to readily minimize the appearance of overall hair thinning and localized hair loss.

The simplest cosmetic approach involves treating the areas of thinning hair with a coloring composition that minimizes the appearance of a bald region by coloring the scalp to match the hair. Such a treatment will minimize the appearance of a thinning region, but it can be difficult to apply such a coloring agent along a thinning hair line with convincing results. Furthermore, this approach is less effective for white or gray hair as the coloration of the scalp does little to blend in the thinning spot. In addition, this cosmetic approach does little to increase the apparent thickness of the hair.

Perhaps the most satisfactory cosmetic approach to date is the application of short colored fibers and/or powder and particles, known as Hair Building Solids (HBS) to the scalp areas in need of treatment. As used herein HBS includes any type of fibers, powder and/or particles used to enhance the appearance of hair thickness and to disguise the appearance of hair thinness. Ideally, the HBS is colored to match the natural hair color of the user and exhibit properties such that static electricity or other similar interactions allow them to adhere to the hair strands as well as the scalp. HBS treatment can result in a very convincing appearance of thickened hair as well as a reduction in the obviousness of balding regions. In addition, it is possible to use hair sprays or other similar compositions to increase the adherence of the fibers to the hair strands and scalp.

The most apparent difficulty with the HBS approach is the process of applying the material to the scalp. The usual means of application is to sprinkle the material over the regions in need of treatment. However, it may be difficult for the user to evenly sprinkle the material in the proper areas. At least one inventor has attempted to solve this difficulty by developing a device to spray the material into position. U.S. Pat. No. 6,168,781 to Ukaji et al. shows a spraying device which uses a source of propellant (e.g., pressurized gas) to deliver a stream of HBS by directing the gas stream over the surface of a container filled with the material. The gas stream picks up fibers and propels them out a nozzle (see FIG. 1*b* of that patent). Some attempt is made to avoid the narrow stream effect by providing an expanded nozzle (see FIG. 2 of that patent). The invention also envisions the simultaneous application of hair spray or other adhesive with the colored fibers (see FIG. 3 of that patent).

This approach of the Ukaji et al. invention is hampered by the requirement for a more or less bulky can of propellant. Because the applicator is designed to suspend the fibers within the propellant stream by blowing the stream over the surface of a mass of fibers, a fairly intense propellant stream is needed to ensure adequate suspension of the fibers. This in turn results in a relatively high velocity stream that may impair the naturalistic settling of fibers into position on the hair and scalp. Further, the simultaneous application of adhesive and fibers may cause the fibers to clump together in an unaesthetic manner. Clearly, there is a continued need for an improved applicator to facilitate the use of HBS for the cosmetic treatment of hair loss

SUMMARY OF THE INVENTION

The present invention provides an improved applicator for HBS cosmetics. The applicator uses a gentle stream of gas, preferably air, to suspend the fibers and waft them onto the users scalp in a directed manner. This allows even application to a desired region and yet allows the fibers to settle naturally into place in an aesthetically pleasing manner.

The fibers become suspended in the applying gas stream by use of the Bernoulli principle. In a first embodiment a low pressure, low velocity gas stream is directed downwards into a mass of HBS in a closed container. The stream of gas suspends the fibers in the gas which then exits through a small orifice in an upper region of the container. The orifice opens into a tubular passageway that ends in a nozzle. Because the passageway is smaller in diameter than the container, there is, according to the Bernoulli principle, an increase in the velocity of the gas (and suspended fibers) flowing through the passageway. This propels the suspended fibers from the nozzle in a more directed fashion than would be expected from the low velocity of the gas stream directed into a container.

In a second embodiment a low pressure, gas stream is directed though a passageway in close proximity to the upper end of a container of the fibers; the end of the passageway ends in a nozzle. A small opening in the passageway connects to the container. The moving gas stream generates a relative vacuum at the opening and pulls the atmosphere out of the container. At the same time a downward directed passageway diverts some of the gas stream and causes it to flow towards the mass of fibers in the container, striking the fibers at approximately right angles to the surface of the mass. This suspends the fibers within the atmosphere of the container so that suspended fibers are drawn through the small opening and into the gas stream ultimately exiting through the nozzle with the gas stream.

Because these designs provide a separate stream of gas to suspend the fibers, the device is able to operate with an extremely low-pressure gas stream so that the suspended fibers essentially are wafted from the application and settle naturally in a controlled area. The nozzle is preferably simply an orifice having dimension similar to the passageway so that the suspended HBS stream is relatively "defocused." A preferred embodiment utilizes air as a suspending gas and provides such air from a rubber bulb. The device looks much like a perfume atomizer. However, in an atomizer, the Bernoulli orifice is connected to a dip tube that extends below the surface of the liquid perfume. Here the Bernoulli orifice is located in the lid or in an upper region of the container and a downwardly directed gas stream is provided to suspend the HBS. The user is able to gently squeeze the bulb and because of the efficiency of the fiber suspension process allow controlled puffs of air and fibers to waft onto a directed region of the scalp.

To achieve optimal adhesion of the applied HBS it is desirable to apply a mild adhesive to the hair and scalp prior to HBS application. A template can be used to apply the adhesive along the hairline and also to apply the HBS. Any HBS not adhering can be brushed or blown away. A preferred embodiment of the applicator includes valves to allow the device to alternately apply HBS and provide a stream of air to blow away excess HBS.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved applicator for hair building fibers.

Figure 1:
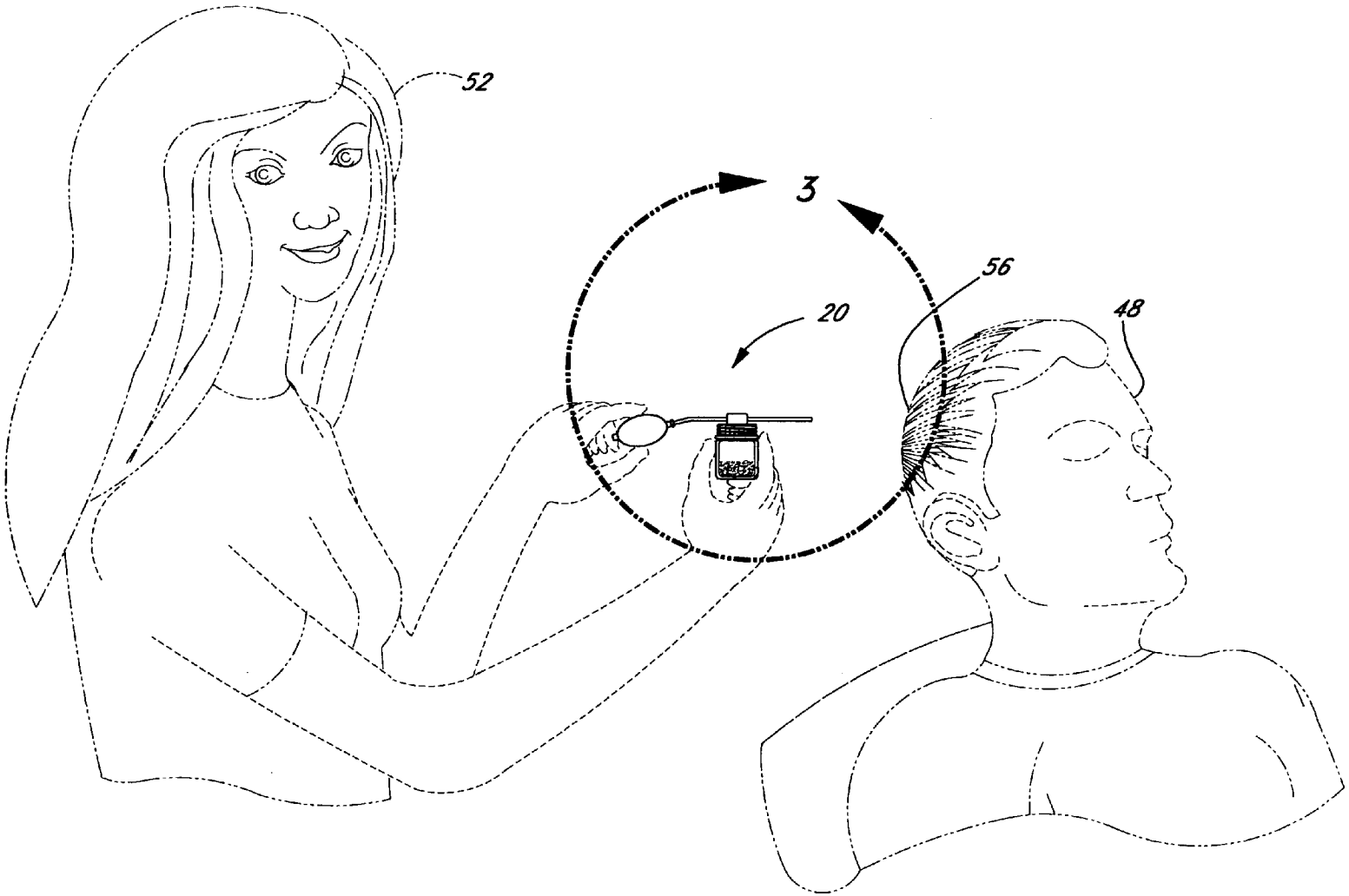
FIG. 1 shows the device in use.
Figure 2:
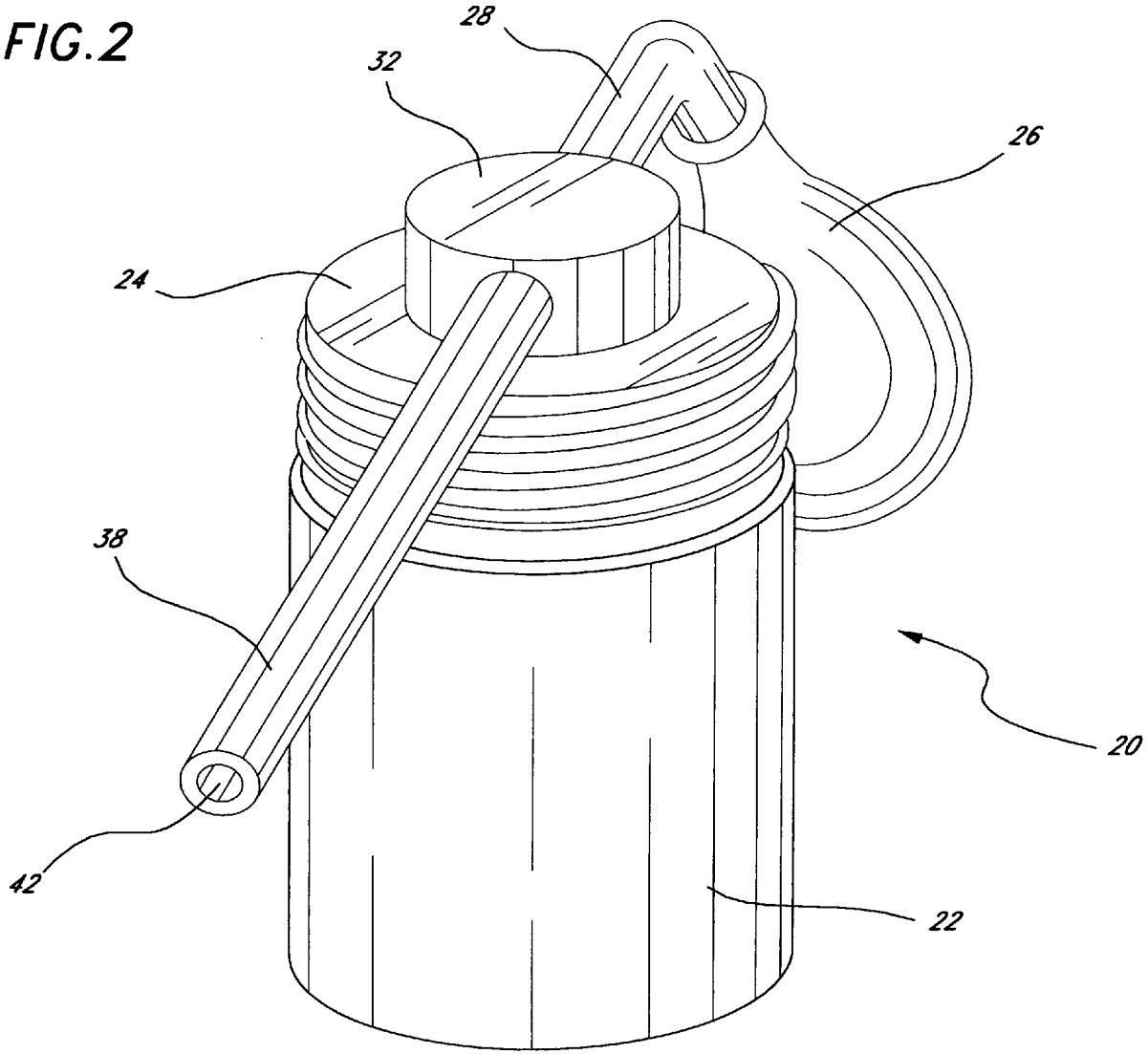
FIG. 2 shows a perspective view of the inventive device.

FIG. 1 is a perspective view of a user 48 receiving HBS from the inventive applicator 20. In most cases the user 48 would apply the HBS himself or herself, but here a cosmetician 52 is shown making the application. FIG. 2 shows a perspective view of an applicator 20 of the present invention. The applicator 20 includes a container 22 for the HBS. Preferably, the container is readily removable to replenish the HBS supply. This also makes it easy to add HBS 18 of different colors so the material can be blended to more closely match the hair color of the user. A lid 24 closes the container and provides attachment for the remainder of the mechanism.

A rubber bulb 26 is attached to one end of a air supply tube 28 the other end of which is connected to a nexus 32 attached to the lid 24. The bulb 26 also has a one way intake valve 34 so that squeezing the bulb 26 results in a flow of air into the air supply tube 28. A suspension tube 36 descends from an underside of the lid 24 and extends towards the HBS in the container 22. The suspension tube 36 is in communication with the air supply tube 28 so that a squeeze of the bulb 26 results in a puff of air exiting the suspension tube 36 to strike and suspend the HBS.

Figure 3:
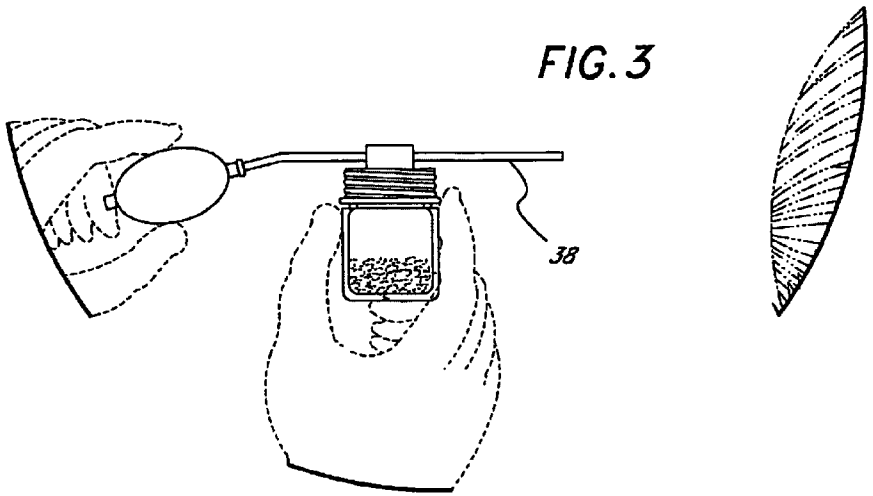
FIG. 3 is a close-up view of region 3 in FIG. 1.
Figure 4:
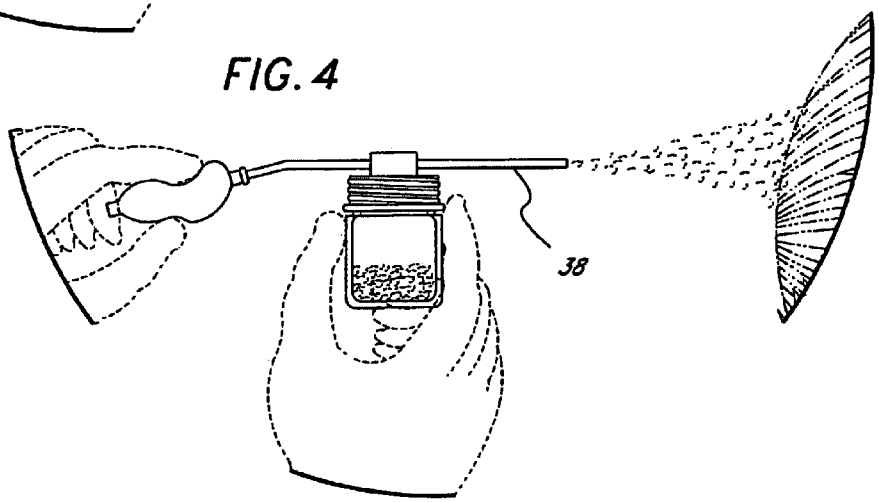
FIG. 4 is a view of FIG. 3 with HBS wafting from the applicator.

A directing tube 38 is axially aligned with the air supply tube 28 an extends from the opposite side of the nexus 32. The directing tube 38 end in a nozzle/orifice 42 which may be of a larger or smaller diameter than the inner diameter of the directing tube 38. An intake orifice 44 is in communication with both the interior of the container 22 and the directing tube 38. FIGS. 3 and 4 show perspective views of the invention 20 applying HBS 18 to an area of thinning hair 56. As explained above, the HFB wafts onto the scalp in a gentle but directed stream 58. It is easy to puff the HBS to evenly disguise regions of thinning hair 56.

If an adhesive is applied immediately prior to the HBS, the wafted material will become bonded to the scalp and hair in an aesthetically appealing manner. Sprayed polymeric materials similar to hair spray work as adhesives, but most hair sprays dry very rapidly whereas in the present application it may be desirable for the spray to remain tacky for a sufficiently long time to waft on the required amount of HBS. Thereafter the adhesive spray should dry completely to avoid a sticky or tacky feel to the hair. Generally, sprays containing at least some water are desirable because they dry somewhat more slowly than do sprays containing only organic solvents. Acrylics and similar film forming polymers such as VP/VA (vinyl acetate/vinyl propanate) copolymers and PVP (polyvinylpyrrolidone) are good adhesives for the present application. A wide range of suitable polymers is known to those of ordinary skill in the art and can be found in references such as the International Cosmetic Ingredient Dictionary and Handbook.

Figure 5:
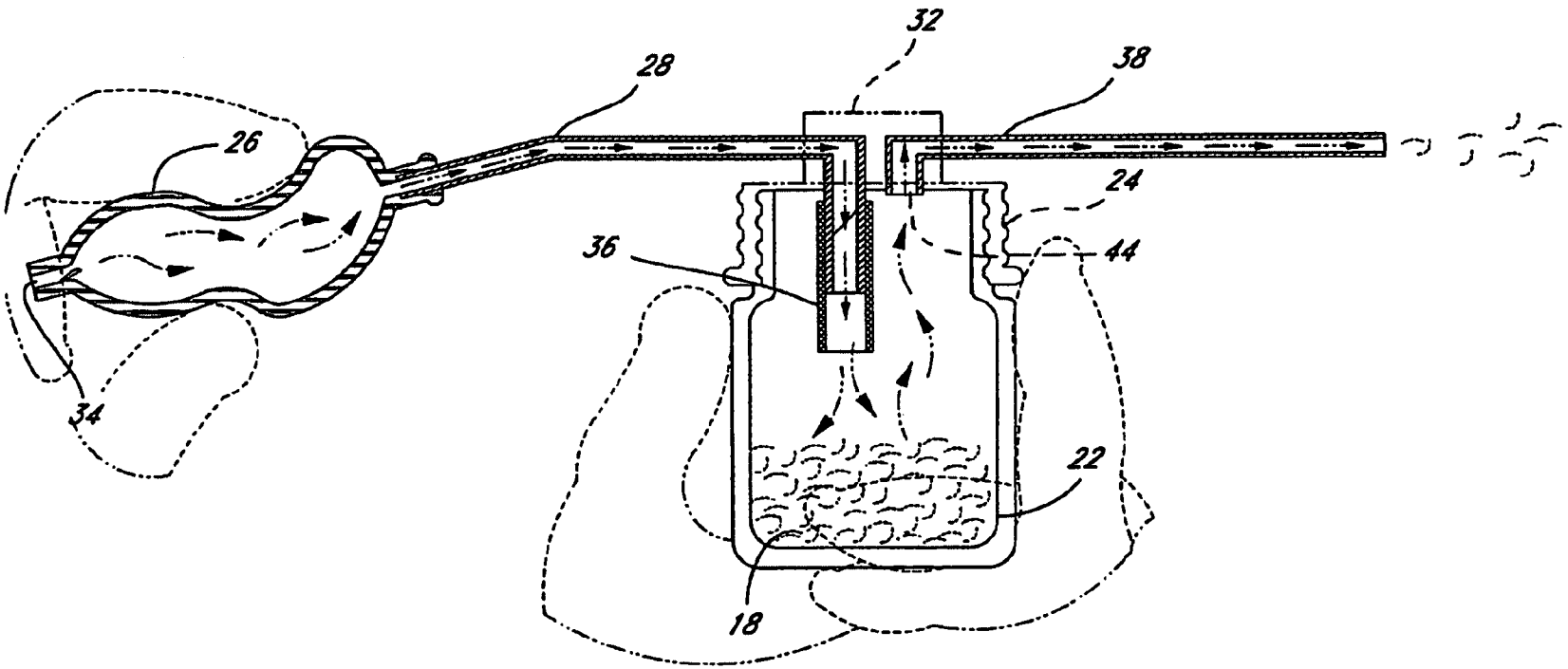
FIG. 5 shows a cross sectional view of a first embodiment of the inventive device.
Figure 6:
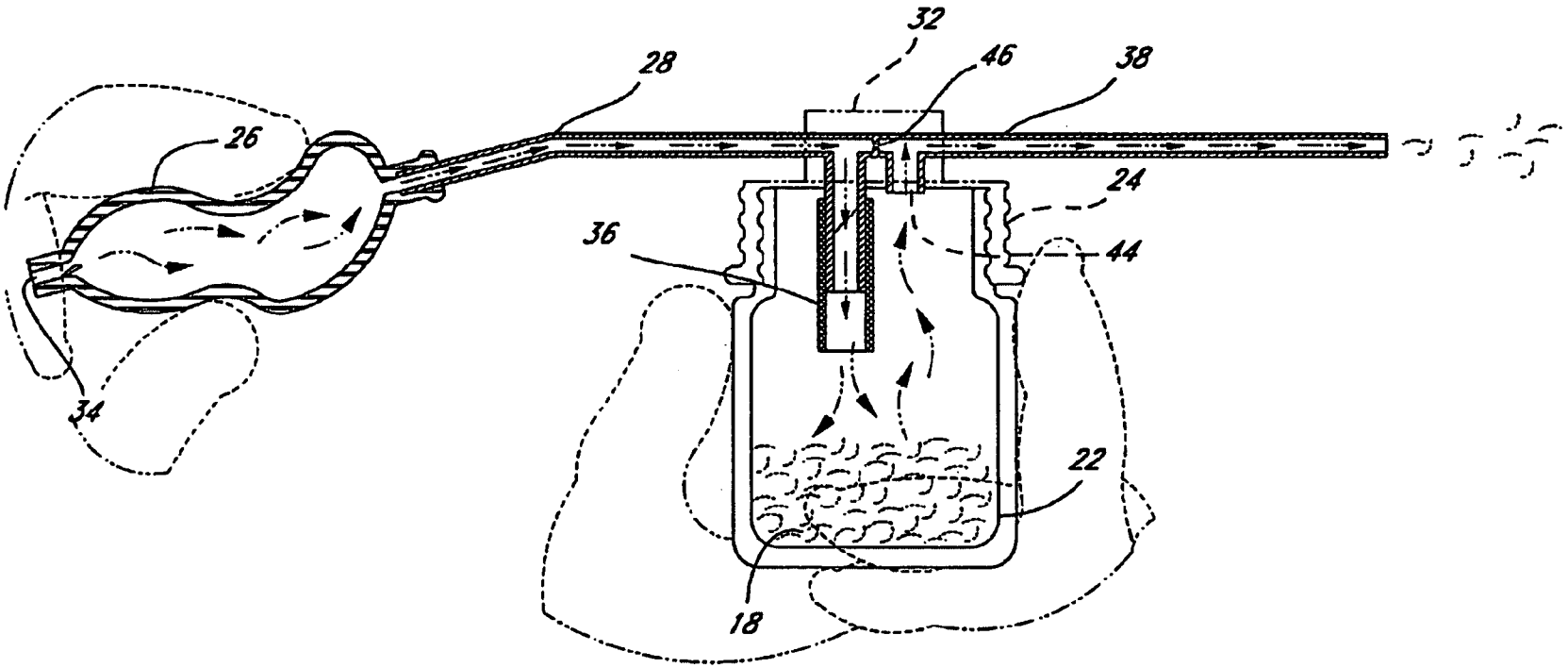
FIG. 6 shows a cross sectional view of a second embodiment of the inventive device.

FIGS. 5 and 6 are cross-sectional views of the device 20 showing two different relationships between the air supply tube 28 and the directing tube 38. In the embodiment of FIG. 6 the air supply tube 28 is continuous with the suspension tube 36 and not connected to the directing tube 38. The directing tube 38 ends within the nexus 32 and the intake orifice 44 provides a connection between the interior of the container 22 and the directing tube 28. In the embodiment of FIG. 6 the air supply tube 28, the suspension tube 36 and the directing tube 38 are all connected together within the nexus 32.

When the bulb 26 is squeezed, a stream of air exits the suspension tube 36 and contacts the HBS 18 within the container 22 causing the fibers to become suspended within the container. In the embodiment of FIG. 5 increased air pressure within the container 22 forces the suspended fibers through the intake orifice 44 and into the directing tube 38 where the velocity of the air stream is increased because of the relatively smaller diameter of the directing tube 38 as compared to the container 22. The stream of fibers exits through the nozzle/orifice 42 as a gentle but directed stream of suspended fibers which waft down onto the scalp. In the embodiment of FIG. 6 some of the air from the air supply tube 28 flows directly into the directing tube 38 causing a decreased pressure at the intake orifice 44, thereby pulling suspended fibers from the container 22. The overall results can be adjusted by varying the diameter of an aperture 46 between the air supply tube 28 and the directing tube 38. It will be apparent to those of skill in the art that as the diameter of the aperture 46 is reduced, the behavior of the embodiment of FIG. 6 approaches that of FIG. 5 becoming identical to FIG. 5 when the aperture 46 is closed.

Figure 7A:
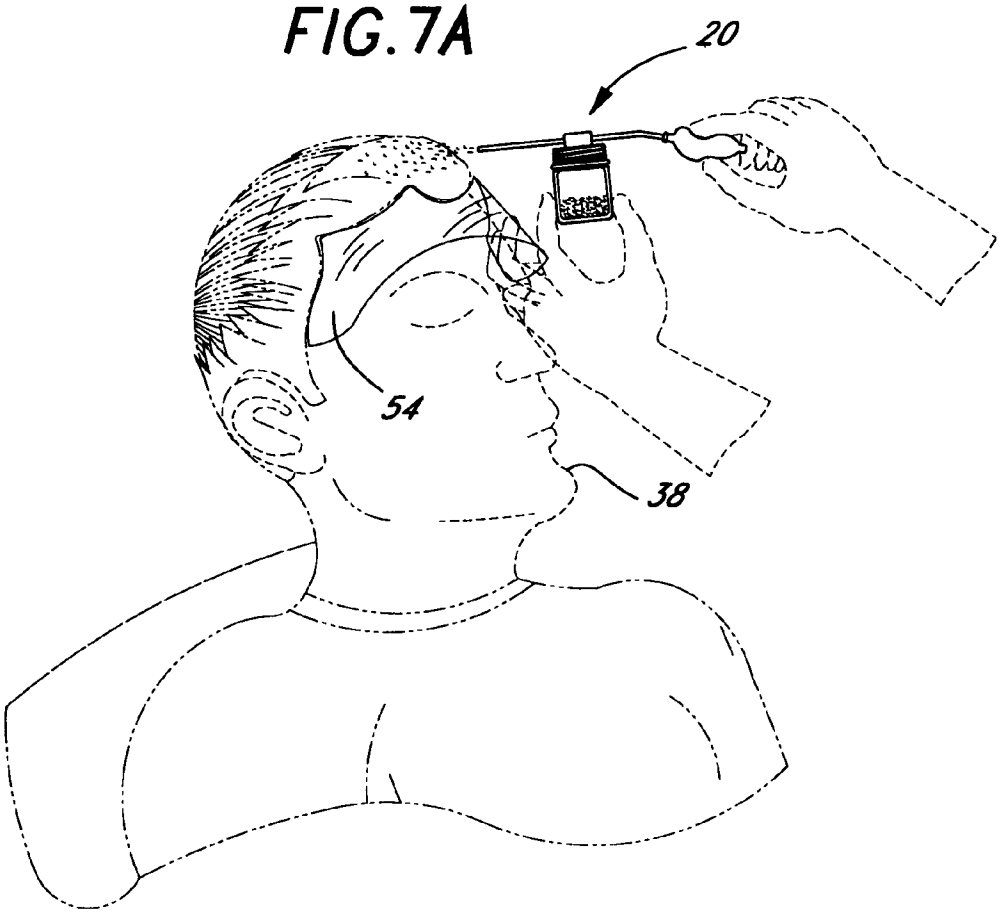
FIG. 7A shows a hairline template for use with the inventive device.
Figure 7B:
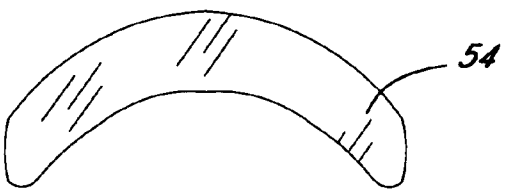
FIG. 7B shows a possible configuration of the template.
Figure 7C:
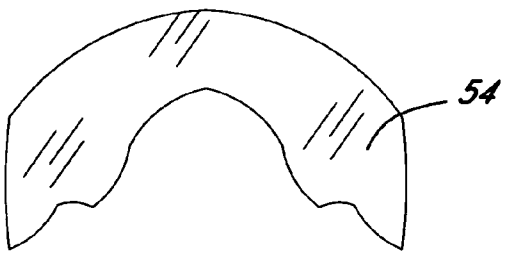
FIG. 7C shows an alternate configuration of the template.

The applicator 20 does an excellent job of evenly applying HBS to most part of the scalp. However, the hairline, particularly at the forehead is difficult because it represents a more or less sharp boundary which is easily obscured by the wafted HBS from the applicator 20. Therefore, it is preferable to use a hairline template 54 as shown in FIG. 7. The template 54 is a negative version of the hairline cut from a thin plastic material—usually transparent. The template 54 mimics not only the overall shape of the hairline but also includes irregularities and feathering (not shown) to produce a convincing result. The template 54 shown in FIG. 7B is intended to be used alternately on the left side and the right side of the hairline while the template 54 shown in FIG. 7C is designed to simultaneously cover the entire hairline.

Figure 8:
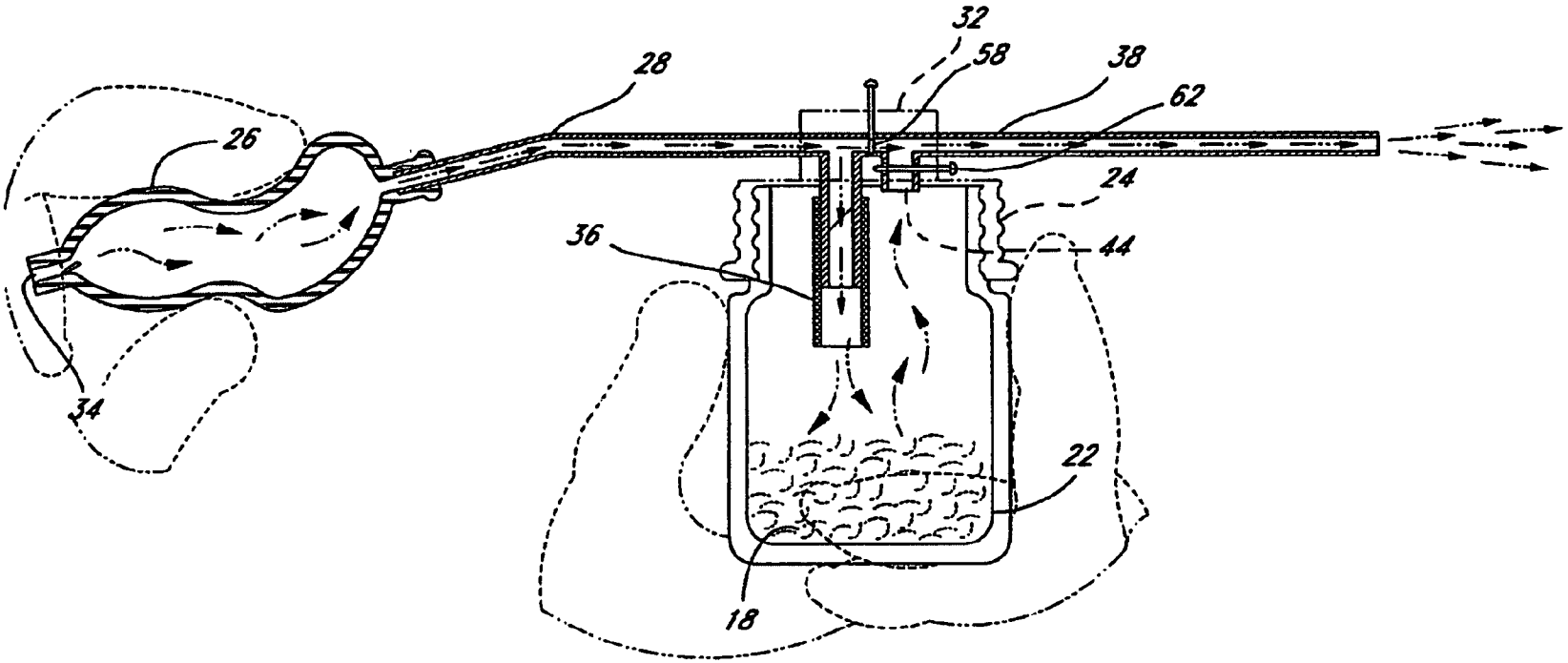
FIG. 8 shows a cross sectional view of a third embodiment of the inventive device which can apply HBS and alternatively blow excess HBS off the user's hair and scalp.

While the template 54 can be used in the application of either or both the adhesive and the HBS, it is often sufficient to use the template to apply only the adhesive. In either case, there is likely to be HBS that either does not fall on an adhesive coated region or else exceeds the capacity of the adhesive. Therefore, following application of the HBS, non-adhering HBS can be blown or brushed away to produce a very convincing hairline. FIG. 8 shows a cross sectional view of a third embodiment of the device 20 that can both apply HBS and provide easily controlled puffs of air to blow any non-adhered HBS away. This device is a modification of the embodiment of FIG. 6 with a first valve 58 located at approximately the position of the aperture 46 (see FIG. 6) and a second valve 62 located at the intake orifice 44. The valves are shown diagrammatically as shafts. In reality a vane would be attached to the shaft so that either pressing in on the shaft or rotating the shaft would cause the vane to close off the respective passageways. Any other type of simple valve such as a pinch valve implemented with a region of flexible tubing would also work and is within the conception of the present invention. As explained above, when the first valve 58 is operated to close the connection between air supply tube 28 and the directing tube 38, the device will operate exactly like the first embodiment (FIG. 5) (assuming that the second valve 62 is in the open position). Such a configuration is used to apply the HBS. Once the HBS has been applied, the first valve 58 is opened and the second valve 62 is closed. In this configuration squeezing the bulb 26 will result in a directed puff of air without suspended HBS. This set up is then used to blow away any non-adhering HBS. Additionally, it is advantageous to leave the device 20 in this configuration between uses since squeezing the bulb 26 will not inadvertently release a puff of HBS.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

I claim:

1. An applicator for depositing cosmetic hair building solids on a selected region, the applicator comprising:

a container for holding a mass of hair building solids;

a gas conduit disposed to direct a stream of gas onto a surface of the mass to suspend the hair building solids;

a passageway for conducting the suspended hair building solids;

a first connection to provide communication directly between the gas conduit and the passapeway;

a first valve opening or closing the first connection between the gas conduit and the passageway;

a first orifice providing a second connection between the passageway and an interior of the container;

and a second valve opening or closing the second connection; and a second orifice through which the suspended hair building solids exit the passageway in a stream to deposit on the selected region.

2. The applicator according to claim 1, wherein the stream of gas is air provided by compression of a rubber bulb in communication with the gas conduit.

3. The applicator according to claim 1, wherein the container is equipped with a lid, and wherein the gas conduit penetrates the lid.

4. The applicator according to claim 1, wherein the second connection provided by the first orifice passes through a portion of the lid.

5. The applicator according to claim 1, wherein some portion of the passageway is longitudinally aligned with some portion of the gas conduit.

6. A method of applying hair building solids comprising the steps of:

providing an applicator comprising:

a container for holding a mass of hair building solids;

a gas conduit disposed to direct a stream of gas onto a surface of the mass to suspend the hair building solids;

a passageway for conducting the suspended hair building solids;

a first orifice providing a connection between the passageway and an interior of the container; and a second orifice thorough which the suspended hair building solids exit the passageway in a stream;

directing the second orifice towards a region in need of hair building solids;

operating the applicator to produce a stream of hair building solids; and allowing the stream to deposit hair building solids on the region.

7. The method according to claim 6 further comprising a step of applying an adhesive to the region.

8. The method according to claim 7, wherein the step of applying an adhesive occurs prior to the step of allowing the stream to deposit.

9. The method according to claim 6 further comprising a step of using a template.

10. The method according to claim 6, wherein the applicator further comprises means for blowing a stream of air not containing hair building solids, further comprising a step blowing a stream of air not containing hair building solids.

* * * * *